US006744344B2

(12) United States Patent
Geuder et al.

(10) Patent No.: US 6,744,344 B2
(45) Date of Patent: Jun. 1, 2004

(54) COMPACT DISCONNECT SWITCH

(75) Inventors: Markus Geuder, Nurenberg (DE); Stefan Kautz, Rückersdorf (DE); Matthias Marondel, Nurenberg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/276,915

(22) PCT Filed: May 25, 2001

(86) PCT No.: PCT/DE01/02014

§ 371 (c)(1),
(2), (4) Date: Nov. 20, 2002

(87) PCT Pub. No.: WO01/95359

PCT Pub. Date: Dec. 13, 2001

(65) Prior Publication Data

US 2004/0004530 A1 Jan. 8, 2004

(51) Int. Cl.[7] ..... H01H 61/04; H01H 71/16

(52) U.S. Cl. ..... 337/140; 337/382; 337/393; 337/395; 60/528; 307/10.7

(58) Field of Search ..... 337/36, 140, 382, 337/393, 395, 186, 187, 198, 268, 290, 292, 295; 60/527–529; 307/10.7

(56) References Cited

U.S. PATENT DOCUMENTS

| | | | | | |
|---|---|---|---|---|---|
| 3,725,835 | A | * | 4/1973 | Hopkins et al. | 337/140 |
| 4,544,988 | A | * | 10/1985 | Hochstein | 361/211 |
| 4,798,968 | A | * | 1/1989 | Deem | 307/10.7 |
| 4,887,430 | A | * | 12/1989 | Kroll et al. | 60/527 |
| 5,612,659 | A | * | 3/1997 | Kerber | 335/177 |
| 5,684,448 | A | | 11/1997 | Jacobsen et al. | |
| 6,040,751 | A | | 3/2000 | Haehnel et al. | |
| 6,078,243 | A | * | 6/2000 | Barnes et al. | 337/140 |
| 6,166,454 | A | * | 12/2000 | Schaller et al. | 307/10.1 |
| 6,424,511 | B1 | * | 7/2002 | Levinas | 361/88 |
| 6,509,824 | B2 | * | 1/2003 | Inaba et al. | 337/295 |

FOREIGN PATENT DOCUMENTS

| | | |
|---|---|---|
| DE | 42 06 162 | 9/1993 |
| DE | 195 25 475 | 1/1997 |
| DE | 197 01 933 | 2/1998 |
| DE | 197 41 919 | 3/1999 |
| DE | 198 32 573 | 2/2000 |
| GB | 2 182 747 | 5/1987 |
| JP | 03-182026 | 8/1991 |

OTHER PUBLICATIONS

"Materials Science and Engineering", vol. A 202, 1995, pp. 148 to 156.
"Intermetallic", vol. 3, 1995, pp. 35 to 46.
"Scripta Metallurgica et Materialia", vol. 27, 1992, pp. 1097 to 1102.
"Z. Metallkde.", vol. 70, issue 10, 1988, pp. 678 to 683.
"Scripta Materialia", vol. 34, No. 2, 1996, pp. 255 to 260.

* cited by examiner

*Primary Examiner*—Anatoly Vortman
(74) *Attorney, Agent, or Firm*—Young & Thompson

(57) ABSTRACT

A disconnect switch for the load circuit of a vehicle battery, includes a movable contact element (81) and a stationary contact element (64) that are linked with a locking mechanism. For releasing the locking mechanism a shape-memory alloy release element (4) is used that contracts when heated. For closing the locking mechanism a shape-memory alloy spring element (110) is provided that induces closure of the mechanism by expansion.

20 Claims, 5 Drawing Sheets

COMPACT DISCONNECT SWITCH

BACKGROUND OF THE INVENTION

The invention relates to a compact disconnect switch for the load circuit of a vehicle battery with the following features, that is with

- an input conductor, which can be connected to an electrode terminal of the battery,
- an output conductor, which can be connected to the load circuit,
- a stationary contact element and a movable contact element for establishing a switching connection between the input conductor and the output conductor,
- a contact carrier, which carries the movable contact element, can be switched between an opening position and a closing position and is prestressed into the opening position by spring force,
- a locking mechanism, which fixes the contact carrier in the closing position or returns it into this position, and means for opening the locking mechanism.

A disconnect switch of this type is disclosed by DE 197 01 933 C1. It has a contact rocker, which is pivotably mounted in a housing and carries a movable contact indirectly via a contact spring acting as a lever arm. For returning the contact rocker into the opening position, a tear-open spring is provided. A locking mechanism comprises a setting arm and a switch pawl, the switch pawl locking the setting arm on the contact rocker and the setting arm prestressing the contact rocker in a closing position. In a way similar to the disconnect switches disclosed by DE 198 32 573 A1 or DE 197 41 919 A1, an electromagnet system with an armature which is coupled to the switch pawl is used as the means for opening the locking mechanism. For opening, the magnet system is excited, whereby the switch pawl unlocks the setting arm and the contact rocker is brought into the opening position by the tear-open spring. In the case of the known disconnect switch, however, the movable contact element located in its opening position can only be returned into the contact position manually. For this purpose, the locking mechanism must be brought back into its starting position, ensuring a closed position, for example by means of a toggle-lever joint possibly provided.

However, the use of an electromagnet system in the case of disconnect switches of this type inherently entails the risk that, in instances of severe shock impact, its armature may move even without excitation, with the result that then the load circuit is unintentionally opened. What is more, a high proportion of the weight and space requirement of the electromagnet system can be avoided. In motor vehicle construction in particular, it is indeed endeavored to keep the weight down as much as possible and, on account of the high numbers of units, also to limit the costs of small components.

SUMMARY OF THE INVENTION

The object of the present invention is to develop the disconnect switch according to the cited DE-C1 document to the extent that it is possible to dispense with a generally laborious manual resetting of the locking mechanism and that remote release is made possible. At the same time, it is intended for a compact construction of the disconnect switch to be ensured.

This object is achieved according to the invention by the means for opening the locking mechanism containing as at least one release element of a shape memory alloy, which contracts when heated by being subjected to a heating current, and by the locking mechanism having at least one spring element of a shape memory alloy which acts on the contact carrier, brings about the closing position of the latter and expands when heated by being subjected to a heating current.

The advantages associated with this configuration of the disconnect switch can be seen, inter alia, in that the use of the special release element as a means for opening the locking mechanism has the effect that it takes up much less space in comparison with an electromagnet system. Such a release element, which heats up when subjected to a heating current and thereby contracts, is generally connected to a sensor system, which is subjected to this current, for example in the event of a short-circuit or a vehicle collision. The element is heated up by the current and thus releases the opening of the locking mechanism by its contraction. Corresponding release elements are inexpensive to procure, have a low weight and are therefore also not susceptible to shock impact. Moreover, they require only little space, with the result that they can be advantageously used in a disconnect switch for the load circuit of a vehicle battery. In this case, due to the fixing of their movable contact element in the closed position by means of the locking mechanism, the contact elements are pressed so strongly against each other that even high currents, in particular as occur during the starting operation of a vehicle, can flow. With such a configuration of a disconnect switch, it can then be ensured that, in the case of use on a vehicle battery, it is possible to dispense with an electromagnet system. Consequently, the entire disconnect switch can be arranged much more easily in a housing adapted to an electrode terminal of the vehicle battery, providing a clearance for the electrode terminal itself. The space-saving makes it possible in this case for additional components to be accommodated in the housing.

Use of the special spring element likewise allows the mechanical and electrical components necessary for this purpose to be constructed in a very small space and makes remote switching possible.

Further advantageous configurations of the disconnect switch according to the invention can be taken from the dependent claims.

For instance, the locking mechanism may be formed in particular as a toggle-lever clamping mechanism. In this case, it is advantageous if the clamping element comprises a first lever, acting on the contact carrier, and a second lever, mounted in the housing, which are connected via a central toggle joint to form a toggle lever which, in the almost extended state, locks the contact carrier in its closing position.

The following configurations, to be regarded as advantageous, may also be provided in particular for the disconnect switch:

- Its locking mechanism has a clamping element, which in its extended position presses the movable contact element against the stationary contact element, the release element acting on the clamping element for the opening of the locking mechanism in such a way that said clamping element buckles sideways.
- The release element favorably acts via an actuating arm on the clamping element formed as a toggle lever, it being possible in a special embodiment for the actuating arm also to be formed at the same time as a return spring for the release element.
- The release element acts via the actuating arm almost perpendicularly in relation to the extending axis of the toggle lever on the central toggle joint and moves the latter over the dead center when the release element contracts.

The actuating arm is formed by a cranked leaf spring, the cranked end of which presses on the toggle joint when the release element contracts.

The at least one spring element is rigidly connected on one side to the housing and acts on the opposite side on a toggle lever of the locking mechanism designed as a toggle-lever clamping mechanism. The spring element acting in this way permits a reliable and rapid return into the closing position.

The contact carrier may be a stretched-out contact spring restrained at one end in the housing, which carries the movable contact element approximately in the middle region of its length and, at its free or movable end, engages with an outer end of a first toggle joint lever, thereby forming a first pivot joint.

It goes without saying that means for manually opening and/or closing the contact elements may be additionally provided.

It is also of advantage if the release element can be activated by a short-circuit sensor and/or an acceleration sensor.

Furthermore, it may be possible for the housing to be arranged on an electrode terminal of the vehicle battery.

What is more, a current sensor which is coupled to an input conductor and applies current to the release element when a current threshold is exceeded may be provided in the housing.

An electronic evaluation circuit for activating the release element is expediently arranged in the housing. An NiTi or a NiTiCu alloy, which may possibly also include further components, is advantageously chosen as the shape memory alloy of the at least one release element and/or at least one spring element.

BRIEF DESCRIPTION OF THE DRAWINGS

For further explanation of the invention, reference is made below to the drawing, in which advantageous refinements of the disconnect switch according to the invention are explained and in which, in a slightly schematic representation.

DESCRIPTION OF THE PREFERRED EMBODIMENTS

Figure 1:
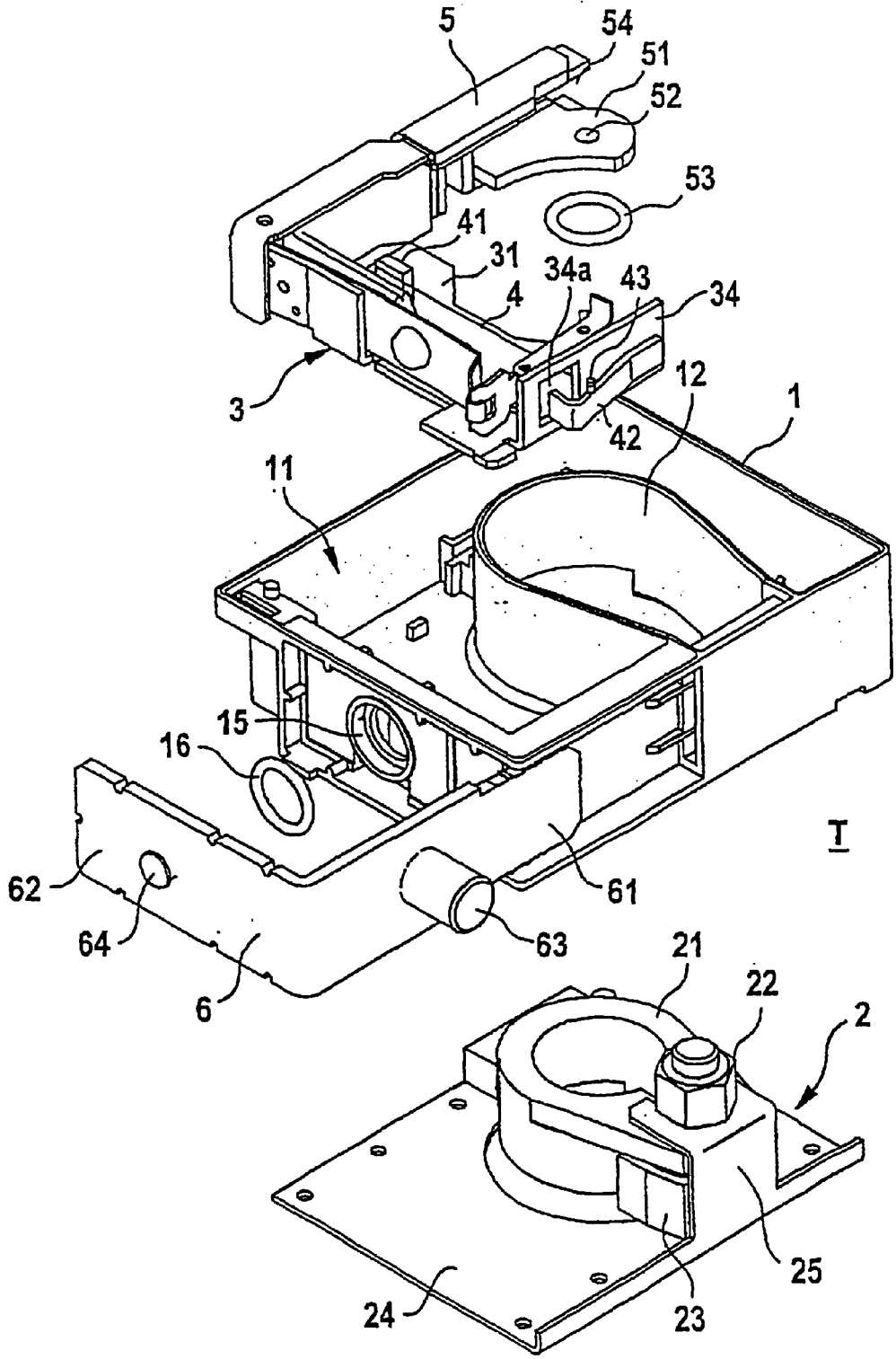
FIG. 1 shows individual subassemblies of a disconnect switch to be configured according to the invention, in a perspective representation.

In this case, respectively corresponding parts are provided in the figures with the same designations.

In the case of the components indicated in the figures, an embodiment of a disconnect switch such as that disclosed by the DE-C1 document cited at the beginning is taken as a basis. The disconnect switch is normally located on the vehicle battery in the engine compartment or in the trunk of a motor vehicle and has a particularly simple construction. Because of its articularly space-saving configuration, the disconnect switch permits the use of at least one spring element according to the invention and at least one release element, which advantageously consist of at least one shape memory alloy. In this case, virtually all known shape memory alloys come into consideration for the spring element and/or the release element of the disconnect switch, it also being possible for different alloys to be chosen for these two elements. Ti—Ni alloys are to be regarded as particularly suitable. For example, variously composed Ti—Ni and Ti—Ni—Cu alloys are disclosed by "Materials Science and Engineering", Vol. A 202, 1995, pages 148 to 156. Various $Ti_{50}Ni_{50-x}Pd_x$ shape memory alloys are described in "Intermetallic", Vol. 3, 1995, pages 35 to 46, and "Scripta METALLURGICA et MATERIALIA", Vol. 27, 1992, pages 1097 to 1102. Instead of the Ti—Ni alloys, it goes without saying that other shape memory alloys are also suitable. For example, Cu—Al shape memory alloys come into consideration. A corresponding Cu—Zn24Al3 alloy is disclosed by "Z. Metallkde.", Vol. 70, issue 10, 1988, pages 678 to 683. A further Cu—Al—Ni shape memory alloy is described in "Scripta Materialia", Vol. 34, No. 2, 1996, pages 255 to 260. It goes without saying that further alloying constituents, such as Hf for example, can also be alloyed in a way known per se with the aforementioned binary or ternary alloys. For the exemplary embodiments explained below, it is assumed that a Ti—Ni shape memory alloy has been selected.

According to FIG. 1, the disconnect switch, denoted generally [lacuna] T, comprises a housing 1, which consists in particular of plastic and is connected to an electrode terminal subassembly 2. The housing 1 may be tightly closed from the upper side by a cover 7 (cf. FIG. 5). A clamping mechanism subassembly 3, which is to be regarded as a locking mechanism and interacts with an integrated release element 4 of a shape memory alloy, can be fitted into the opened housing. What is more, an input conductor 5 and an output conductor 6 are fitted into the housing.

As the representation of FIG. 1 further reveals, the output conductor 6 is fastened to the outer side of the housing 1. This output conductor is configured in an L-shaped manner, a leg 61 being attached to the outer side of the housing by means of a sawtooth contour in a corresponding pocket, while a leg 62 is fixed to the housing by hot stamping. By fixing in this way, the forces of a battery cable screwed onto the output conductor 6 via a bolt 63 are absorbed; at the same time, the entire housing is reinforced by the L-shaped bending of the output conductor. Fastened to the leg 62 from the inner side is the stationary contact element 64, which passes through a round lead-through 15 into the interior of the housing. The lead-through 15 for this stationary contact element 64 is sealed by an O-ring 16. The contact element 64 comprises, for example, a round copper part with plated-on or welded-on contact material.

The plastic housing 1 has a switching space 11, which is bounded by a bottom plate and side walls and receives the functional parts of the disconnect switch. A space for receiving an electrode terminal 21 has also been made within the housing by a curved dividing wall 12. Since the cover 7 also has a corresponding clearance 71 (cf. FIG. 7), the closed and sealed housing of the disconnect switch can be placed onto the battery electrode of a motor vehicle battery with the electrode terminal 21 in such a way that the latter or a corresponding clamping screw 22 remains accessible from the outside. The electrode terminal 21 acts together with a clamping shoe 23, which is riveted to a base plate 24 of sheet metal. At the outer edge, the latter rests with a U-shaped bend 25 on the electrode terminal 21, where it is fixed by means of the clamping screw 22. The plastic housing is placed onto the base plate 24 and hot-stamped, whereby the entire battery disconnect switch is supported on both sides on the electrode terminal.

Figure 3:
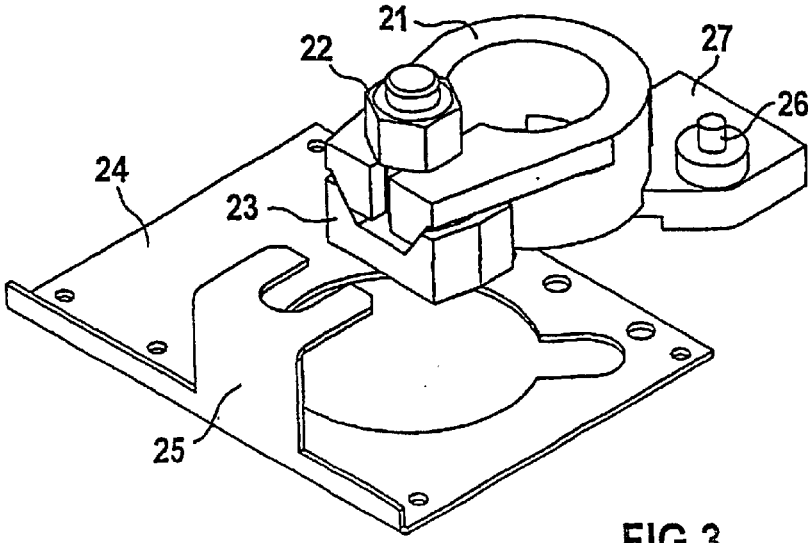
FIG. 3 shows an electrode terminal subassembly according to FIG. 1, in a semi-assembled state.

As can be seen from FIG. 3, cast onto an extension 27 of the electrode terminal shoe 23 is a round pin 26, which protrudes upward through the housing 1 consisting of plastic into the switching space 11. By means of this pin 26, the battery current is passed to the input conductor 5, which is riveted onto the inside, into the interior of the disconnect switch.

This input conductor 5 consists, for example, of copper sheet and is bent in a U-shaped manner. As can also be seen from FIG. 1, a leg 51 is in this case fitted by a round hole 52 onto the pin 26 and riveted. The round cross section of the pin 26 is sealed in this case in a waterproof manner with respect to the bottom of the housing 1 by an O-ring 53. On the leg 51 of the input conductor there may also be arranged a ferrite body 54 with a clearance, into which a current sensor (not represented in figure), for example a Hall-effect sensor, for monitoring the battery current can be inserted (cf. FIG. 2)

Figure 2:
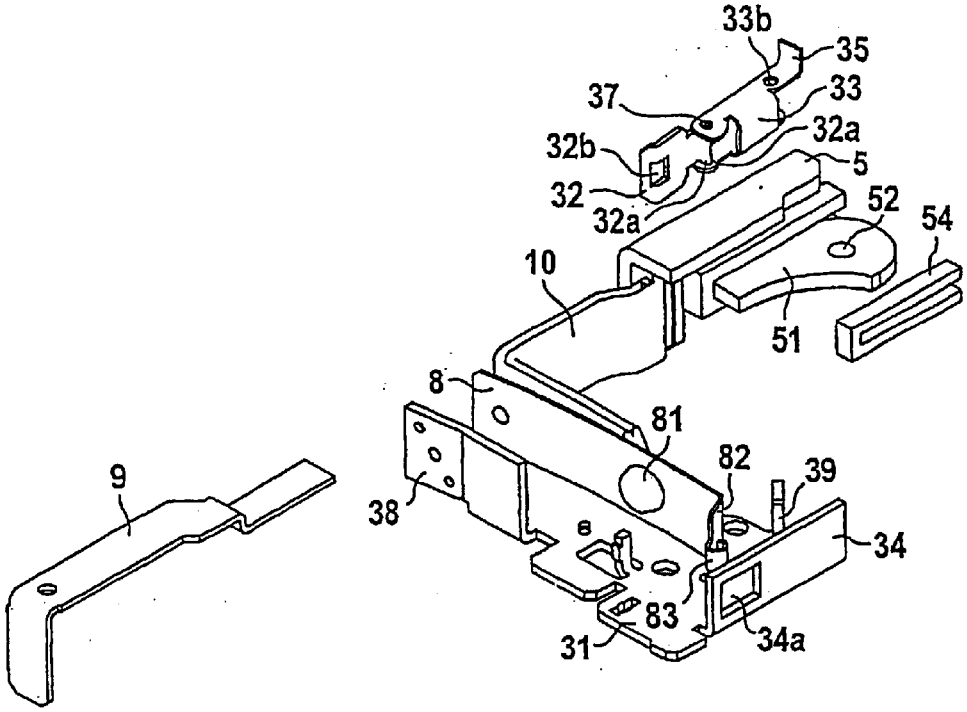
FIG. 2 shows a clamping mechanism subassembly with a release element of the disconnect switch from FIG. 1, in a partly assembled state.

As emerges from the view of a detail of FIG. 2, on a leg of the input conductor 5 which is bent away perpendicularly there is welded a stranded wire 10 for passing on the current to a movable contact element 81. This movable contact element 81 is fastened to a resilient contact carrier 8, which is fixedly restrained on the housing. The stranded wire 10 comprises two flat stranded wires placed one over the other, it being possible for good flexibility in the actuating direction of the contact element 81 to be ensured in the case of large conductor cross sections. The contact carrier 8 is configured as a flat-form spring restrained at one end, by means of which a contact-tearing-open force, the contact travel and also the contact force and the deflection are provided. In this way, the function of a contact spring, a return spring and a contact rocker can be ensured. The movable contact element 81 is fastened approximately at the middle of the free spring length of the contact carrier. Its free spring end 82 is bent away and shaped into a hook 83, by means of which the contact spring is in engagement with a clamping mechanism.

The corresponding subassembly 3 of the clamping mechanism comprises a toggle-lever clamping mechanism, which is arranged on a carrier plate 31. The contact spring is fastened to a lug 38, which is bent perpendicularly upward, of the carrier plate 31. Furthermore, bent perpendicularly upward from the carrier plate 31 is a square pin 39, which serves as a pivot point, fixed to the frame, for the clamping mechanism. The toggle lever of the clamping mechanism is formed by two correspondingly bent sheet metal parts, that is a first lever 32 and a second lever 33. Cut free on the first lever 32 are two joint pins 32*a*, which lie in joint holes of the first toggle lever 32, which is bent in a U-shaped manner, and form with said toggle lever a toggle joint 37. The second toggle lever 33 has further joint holes 33*a* and 33*b*, by which the second lever is mounted on the square pin 39 mentioned. The first lever 32 has at its outer end, i.e. remote from the central toggle joint, an eyelet-shaped cutout 32*b*, which interengages with the hook-shaped end portion 83 of the resilient contact carrier 8. In the joint holes 33*a* and 33*b* of the second lever 33 and also in the hook-shaped end portion 83 of the contact spring, the respective joint pins and the rim of the eyelet of the first lever respectively bear with their edges in the clamped state of the toggle joint. At the moment of release, when the central toggle joint is moved over the dead center, these edges acts like a knife-edge bearing, whereby the bearing friction at the moment of release is very low and requires only a small releasing force.

As also emerges from FIG. 2, an additional emergency-current connection 9, which is connected to the input conductor 5, is arranged on the housing 1. It serves, for example, for maintaining emergency circuits, such as for example a hazard warning system, or else for releasing the disconnecting operation. As clearly emerges from the plan view of FIG. 4, the thermal release element 4 of the shape memory alloy in the form of a wire or possibly also a strip is clamped within the clamping mechanism subassembly between a suspension 41 and an actuating arm 42. The suspension 41 takes the form of a lug which protrudes perpendicularly in relation to the carrier plate 31 of the clamping subassembly. The actuating arm 42 is arranged on the opposite side of the toggle lever system on a lug 34, which is bent upward perpendicularly in relation to the carrier plate 31, and acts in the buckling-out direction on the toggle lever system. Provided in the lug 34 is a cutout 34*a* (see also FIG. 2), through which, on the one hand, the actuating arm cranked at the end acts with its end face on the toggle joint 37 and through which, on the other hand, the release element 4 is led from the suspension 41 to the actuating arm 42. For fastening the release element to the actuating arm 42, an additional mounting 43 is provided on the latter. The actuating arm 42 is formed in a resilient manner, with the result that it constantly prestresses the release element with a certain spring force. The lug 34 serves on the opposite side of the actuating arm 42 also as a bearing edge of the toggle-lever clamping mechanism in the clamped state.

For releasing the clamping mechanism, current is applied to the release element 4 via two lines (not represented). As a result of the current, the release element heats up and contracts. The corresponding contraction causes the end face of the cranked actuating arm 42 to press onto the second lever 33 level with the toggle joint 37. The actuating arm 42 pushes the toggle joint 37 over its dead center and is subsequently pushed through completely on account of the returning force of the resilient contact carrier 8.

Figure 4:
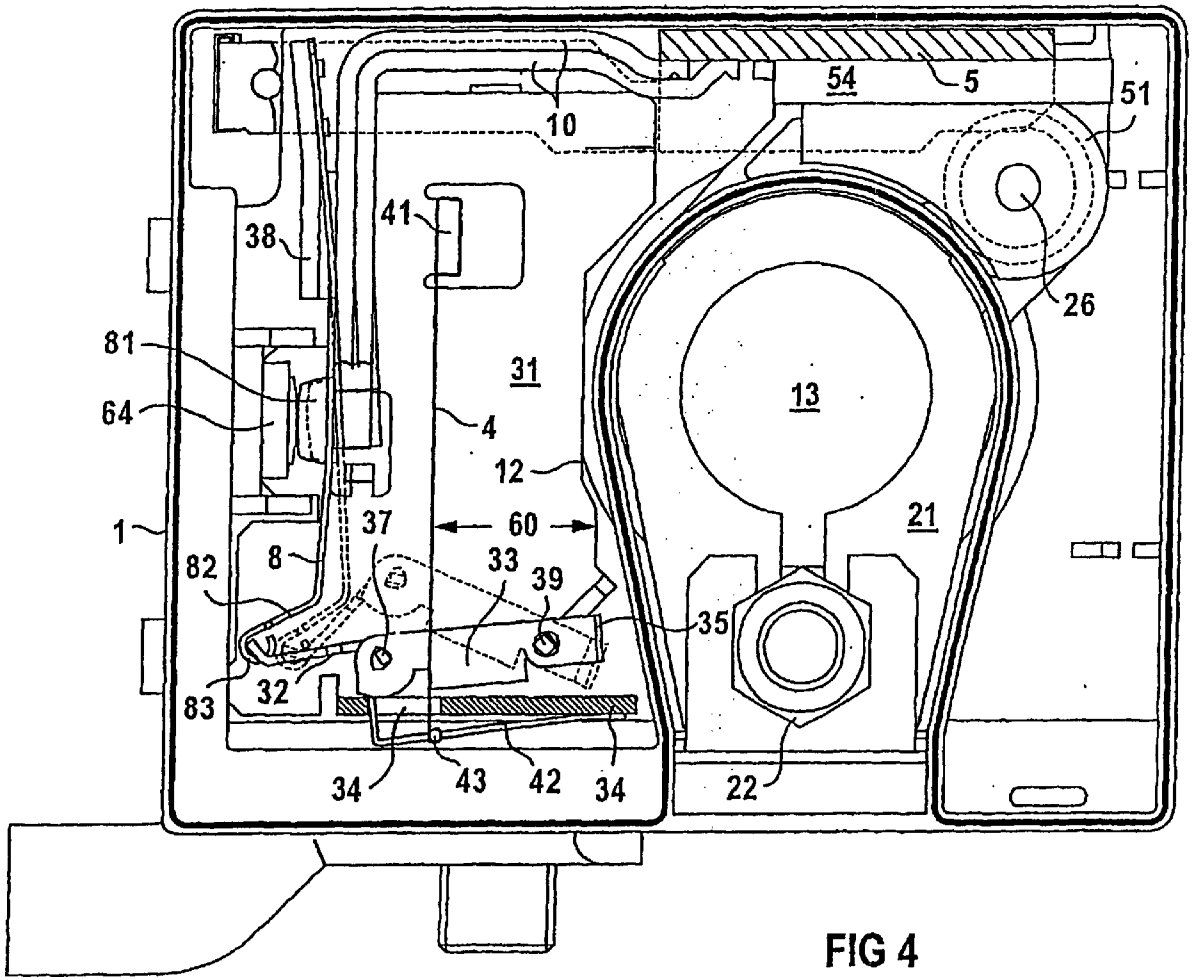
FIG. 4 shows a plan view of the disconnect switch according to FIG. 1.

On the second lever 33 there is bent upward behind the pivot joint, which is fixed to the frame, at the pin 39 a switching tab 35, which protrudes upward through a hole 72 in the cover 7 (cf. in this respect FIG. 5) or is accessible from the outside and so may serve for manual switching on and off. With the aid of a screwdriver or similar implement, the switching tab 35 can be switched over, in order to clamp the toggle lever again and close the contact spring again. Apart from manual switching on again in this way, however, corresponding manual switching off is conversely also possible. Both positions are indicated in FIG. 4: the closing position of the contact elements 81 and 64 by means of the representation of the parts 8, 32, 33 and 37 by solid lines, the opening position by dashed lines. The release of the switching-off operation is explained below:

In the state of rest, the toggle lever is clamped, the central toggle joint 37 having been pressed slightly outward over the dead center and the first lever 32 bearing against the lug 34. The resilient contact carrier 8 has in this case been pressed counter to its prestressing into the closing position and the movable contact element 81 is lying on the stationary contact element 64. When the release element 4 is excited, the actuating arm 42 is drawn in the direction of the toggle lever system and pushes with its cranked end face the central toggle joint 37 over the dead center. Beyond the dead-center position, the toggle lever is deflected by the then released contact and tearing-open force of the contact spring, and the spring contact is opened. The contact carrier 8 and the toggle lever 32, 33 then assume the position depicted by dashed lines in the figure. The transmission via the toggle-lever clamping mechanism allows the high contact and tearing-open forces of the contact spring to be switched off with relatively small releasing forces and consequently by a thermocouple; the frictional force component is in this case relatively small. For switching on again, the toggle lever is clamped again, the lever 33 being moved into the position of rest by means of activation of a spring element according to the invention, explained later on the basis of FIGS. 6 and 7. In this case, the thermocouple 4 is extended again by the returning force of the resiliently formed actuating arm 42. For releasing the disconnect switch, the release element 4 is supplied with a release signal in the form of a heating current, which is generated, for example, by an electronic evaluation circuit. A corresponding evaluation circuit may be accommodated in the housing 1. It is connected to the release element 4 and receives, for example, sensor signals from an acceleration sensor which is present in the vehicle for the release of an airbag. In addition or instead of this, the disconnect switch may also be released in the event of overloading. For this purpose, a current sensor, for example in the form of a Hall-effect sensor, which measures the load current given off by the battery by a ferrite ring 54 enclosing the input conductor (cf. in this respect also FIG. 2), may be accommodated in the housing of the disconnect switch. If a predetermined threshold is exceeded, a corresponding excitation pulse is then emitted in the evaluation circuit to the release element 4, which activates the disconnect switch within a few milliseconds, thereby opening the contact elements 64 and 81.

Figure 5:
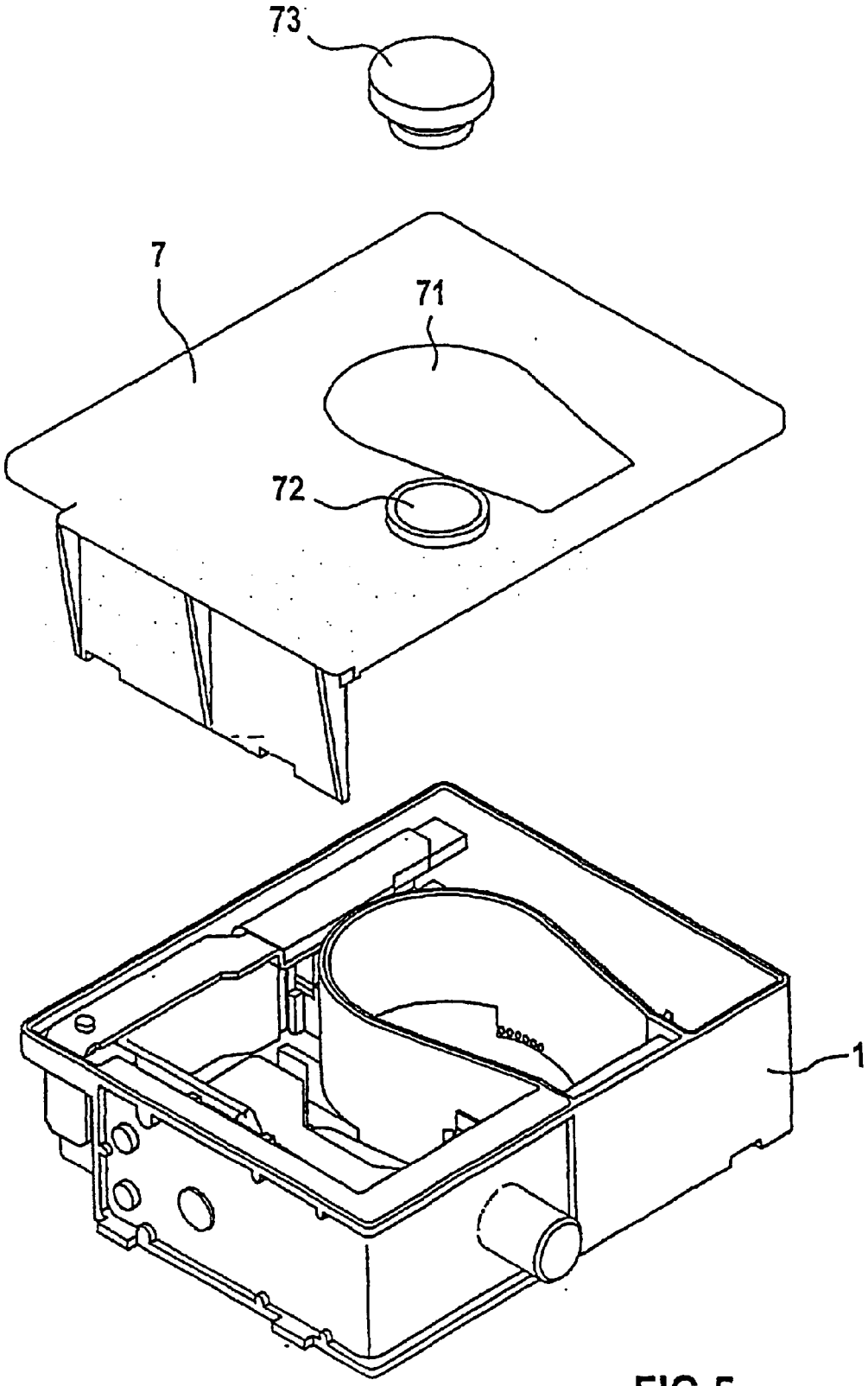
FIG. 5 shows parts of the disconnect switch according to FIG. 1 in the assembled state, but with an open cover.

According to FIG. 5, the switching tab 35 (according to FIG. 4) lies in a recessed region of the cover 7 closing the housing 1 in a waterproof manner. The switching tab is in this case accessible through an opening 72, which can be sealed from the outside by means of a closing plug 73. In the figure, the clearance 71 for access to the electrode terminal 21 (according to FIG. 2) can be seen.

Figure 6:
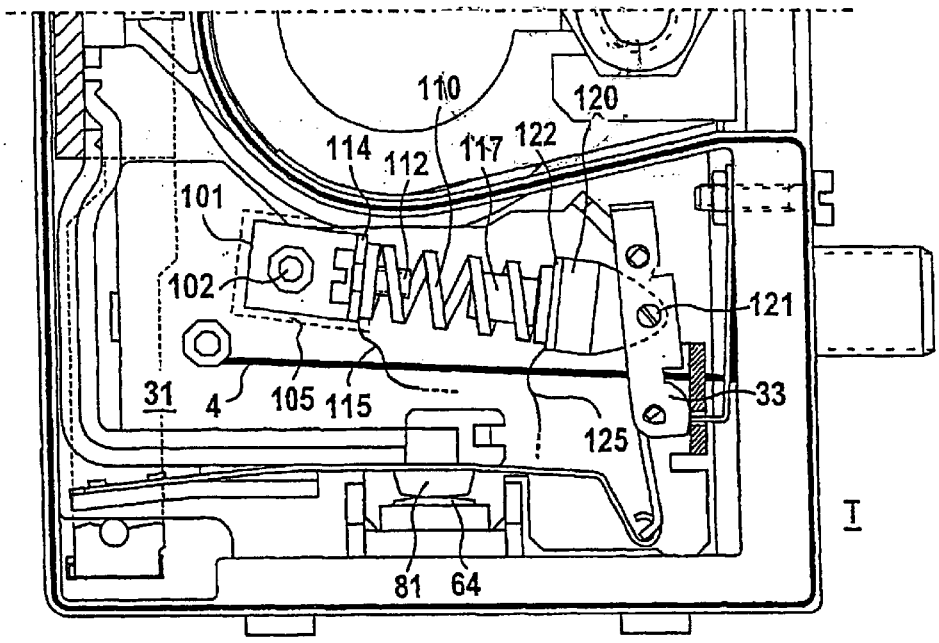
FIG. 6 shows a part of the disconnect switch according to FIG. 4, with a spring element installed, in the opened contact state
Figure 7:
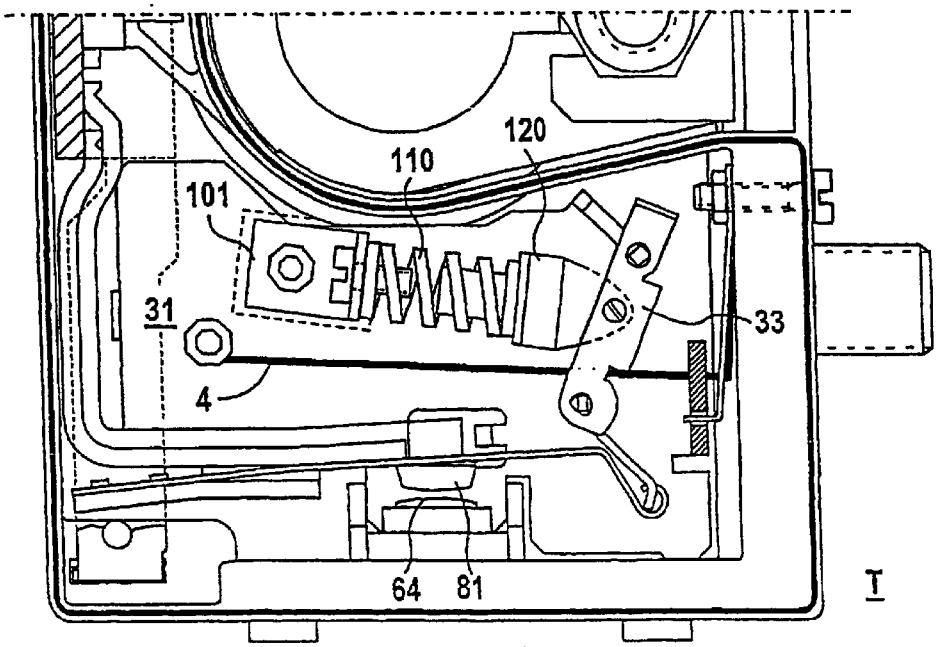
FIG. 7 shows the part of the disconnect switch according to FIG. 6 in the closed contact state.

As also emerges from FIG. 4, between the release element 4 in the form of a wire and the dividing wall 12 of the plastic housing 1 there is adequate intermediate space 60 to accommodate further parts of the disconnect switch T. According to the invention, this space is intended to serve for receiving at least one spring element of a shape memory alloy, which is intended to act on the second lever 33. The corresponding representation of such a spring element is revealed by FIGS. 6 and 7, FIG. 7 showing the opening position and FIG. 6 showing the closing position of the contact elements of the disconnect switch according to the invention:

On the carrier plate 31, a mounting 101 is fastened by a screw coupling 102. An insulation 105, for example in the form of a Kapton film, which is only indicated in the figure, must be introduced between the carrier plate 31 and this mounting 101 if the mounting is itself current-conducting. The screw coupling 102 must in this case also be insulated with respect to the carrier plate 31, for example by using a plastic screw. However, the mounting may also itself consist of a non-current-conducting material, thereby ensuring the insulation between the carrier plate and the spring element, denoted by 110, of the shape memory alloy. The mounting 101 preferably has the form of an L or angle, with the result that surface-area contact is available for the spring element 110. To be able to guide the spring element, a guide pin 112 of a non-current-conducting material can be introduced into the mounting 101. A plastic screw is suitable, for example, for this purpose. To allow the spring element 110 of the shape memory alloy to be subjected to a heating current, either the mounting 101 of a current-conducting material, such as Al, steel or copper, for example, is chosen or a first flat contact washer 114 is introduced between the mounting and the spring element. The mounting 101 or this contact washer 114 are connected to an insulated conductor wire 115, only indicated in the figure, for example by soldering with a PbSn solder, which leads from the battery disconnect switch to a current source.

Likewise provided on the opposite side of the spring device 110 of the shape memory alloy is a guide pin 117 for the latter, which is of a non-current-conducting material. After the mounting 101 has been securely screwed to the carrier plate 31, a guide joint represents the movable part of the spring element 110. The guide joint must in this case be formed in such a way that the return of the second (movable) lever 33 of the toggle-lever clamping mechanism is possible by means of a joint pin 121, and at the same time the guidance and power supply of the spring element 110 can be ensured. The guide joint 120 must consist of a non-current-conducting material. For the power supply of the spring element 110, a second flat contact washer 122 is introduced between the spring element and the guide joint. A connection to a power source outside the battery disconnect switch is created via an insulated, soldered-on conductor wire 125.

If the spring element 110 is then subjected to a heating current, it expands and, by means of the guide joint 120, pushes the second lever 33 of the toggle-lever clamping mechanism back into the starting position, whereby the movable contact element 81 is again brought into electrically conducting connection with the stationary contact element 64. In this way, the closing position of the battery disconnect switch is restored.

The spring element 110 is selected such that the return of the toggle lever can be brought about within a few seconds, for example 3 s, and the opening of the toggle lever against the spring force of the spring element is possible again after a few seconds, for example after 10 seconds. At the same time, it is taken into account that the release element 4 of a shape memory alloy, in the form of a wire, can open the toggle lever with a reaction time of <50 ms against the spring force of the spring element 110.

The main characteristic data of a corresponding spring element 110 are listed below as an actual exemplary embodiment:

| | |
|---|---|
| material: | NiTiCu alloy with a transformation temperature of >150° C. and a hysteresis of <25° C.; |
| wire diameter: | 1.2 mm |
| axial spring length (compressed): | 9.6 mm; |
| axial spring length (relaxed) : | 11.2 mm; |
| number of turns: | 7; |
| inside diameter: | 8.2 mm; |
| outside diameter: | 10.6 mm; |
| setting path: | up to 8 mm; |
| setting force: | up to 20 N; |
| current requirement: | 9 A at U: 2 V; |
| return time: | 5 s; |

Release by a corresponding release element 4 of the shape memory alloy, in the form of a wire, against the spring element 110 after about 15 s. The return time and the release time are in this case dependent on the size of the heating current applied. It is found here that, with increasing current intensity, the return time can be shortened.

In the case of the exemplary embodiment represented above, it was assumed that the release element of one of the known shape memory alloys, such as in particular an NiTi or NiTiCu alloy in wire or strip form, is clamped as a stretched-out element between a fixed suspension and a locking mechanism, which brings about the mechanical opening of the contact elements. It goes without saying that other configurations of the release element of the shape memory alloy are also conceivable. Alternative embodiments can be taken, for example, from the DE patent application cited at the beginning.

What is claimed is:

1. A compact disconnect switch for the load circuit of a vehicle battery with the following features, that is with a housing (1);

an input conductor (5) mounted in the housing (1), which can be connected to an electrode terminal (21) of the battery, an output conductor (6), which can be connected to the load circuit, a stationary contact element (64) and a movable contact element (81) for establishing a switching connection between the input conductor (5) and the output conductor (6), a contact carrier (8), which carries the movable contact element (81), can be switched between an opening position and a closing position and is prestressed into the opening position by spring force, a locking mechanism (3), which fixes the contact carrier (8) in the closing position or returns it into this position, and means for opening the locking mechanism, the means for opening the locking mechanism containing at least one release element (4) of a shape memory alloy, which contracts when heated by being subjected to a heating current, and the locking mechanism (3) having at least one spring element (110) of a shape memory alloy which acts on the contact carrier (8), brings about the closing position of the latter and expands when heated by being subjected to a heating current.

2. The switch as claimed in claim 1, characterized in that the locking mechanism is formed as a toggle-lever clamping mechanism.

3. The switch as claimed in claim 1, characterized in that the locking mechanism has a clamping element (32, 33), which in its extended position presses the movable contact element (81) against the stationary contact element (64), and the release element (4) acts on the clamping element (32, 33) for the opening of the locking mechanism in such a way that said clamping element buckles sideways.

4. The switch as claimed in claim 3, characterized in that the release element (4) acts via an actuating arm (42) on the clamping element (32, 33).

5. The switch as claimed in claim 4, characterized in that the actuating arm (42) is formed as a return spring for the release element (4).

6. The switch as claimed in claim 4, characterized in that the clamping element comprises a first lever (32), acting on the contact carrier (8), and a second lever (33), mounted in the housing (1), which are connected via a central toggle joint (37) to form a toggle lever which, in the almost extended state, locks the contact carrier (8) in its closing position.

7. The switch as claimed in claim 6, characterized in that the release element (4) acts via the actuating arm (42) almost perpendicularly in relation to the extending axis of the toggle lever on the central toggle joint (37) and moves the latter over the dead center when the release element (4) contracts.

8. The switch as claimed in claim 6, characterized in that the actuating arm (42) is formed by a cranked leaf spring, the cranked end of which presses on the toggle joint (37) when the release element (4) contracts.

9. The switch as claimed in claim 1, characterized in that the at least one spring element (110) is rigidly connected on one side to the housing (1) and acts on the opposite side on a toggle lever (32, 33, 37) of the locking mechanism having a toggle-lever clamping mechanism.

10. The switch as claimed in claim 1, characterized in that the contact carrier (8) is a stretched-out contact spring restrained at one end in the housing (1), which carries the movable contact element (81) approximately in the middle region of its length and, at its free or movable end (82), engages with an outer end of a first toggle joint lever (32), thereby forming a first pivot joint.

11. The switch as claimed in claim 1, characterized in that means for manually opening and/or closing the contact elements are additionally provided.

12. The switch as claimed in claim 1, characterized in that the release element (4) can be activated by a short-circuit sensor and/or an acceleration sensor.

13. The switch as claimed in claim 1, characterized in that the housing (1) can be arranged on an electrode terminal of the vehicle battery.

14. The switch as claimed in claim 1, characterized in that a current sensor which is coupled to an input conductor and applies current to the release element (4) when a current threshold is exceeded is provided in the housing (1).

15. The switch as claimed in claim 1, characterized in that an electronic evaluation circuit for activating the release element (4) is arranged in the housing (1).

16. The disconnect switch as claimed in claim 1, characterized in that the shape memory alloy of the at least one release element (4) and/or at least one spring element (110) is an NiTi or a NiTiCu alloy, which may possibly also include further components.

17. The switch as claimed in claim 2, characterized in that the locking mechanism has a clamping element (32, 33), which in its extended position presses the movable contact element (81) against the stationary contact element (64), and the release element (4) acts on the clamping element (32, 33) for the opening of the locking mechanism in such a way that said clamping element buckles sideways.

18. The switch as claimed in claim 5, characterized in that the release element (4) acts via an actuating arm (42) on the clamping element (32, 33).

19. The switch as claimed in claim 6, characterized in that the actuating arm (42) is formed as a return spring for the release element (4).

20. The switch as claimed in claim 2, characterized in that the clamping element comprises a first lever (32), acting on the contact carrier (8), and a second lever (33), mounted in the housing (1), which are connected via a central toggle joint (37) to form a toggle lever which, in the almost extended state, locks the contact carrier (8) in its closing position.

* * * * *

UNITED STATES PATENT AND TRADEMARK OFFICE

CERTIFICATE OF CORRECTION

PATENT NO. : 6,744,344 B2
DATED : June 1, 2004
INVENTOR(S) : Markus Geuder et al.

It is certified that error appears in the above-identified patent and that said Letters Patent is hereby corrected as shown below:

Title page,
Insert Item:
-- [30] Foreign Application Priority Data
June 6, 2000 (DE)……..10027519 --.

Signed and Sealed this

Eighth Day of February, 2005

JON W. DUDAS
*Director of the United States Patent and Trademark Office*